US009784064B2

(12) United States Patent
Norman et al.

(10) Patent No.: US 9,784,064 B2
(45) Date of Patent: Oct. 10, 2017

(54) METHODS AND SYSTEMS FOR OPERATING A DOWNHOLE TOOL

(71) Applicant: Dril-Quip, Inc., Houston, TX (US)

(72) Inventors: Dale Norman, Spring, TX (US); Fife Ellis, Houston, TX (US); Travis Potier, Lafayette, LA (US); Colter Pesek, Sugar Land, TX (US); Jarryd Daniels, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 624 days.

(21) Appl. No.: 14/327,887

(22) Filed: Jul. 10, 2014

(65) Prior Publication Data

US 2015/0013995 A1 Jan. 15, 2015

Related U.S. Application Data

(60) Provisional application No. 61/845,475, filed on Jul. 12, 2013.

(51) Int. Cl.
*E21B 33/04* (2006.01)
*E21B 23/01* (2006.01)
*E21B 23/00* (2006.01)

(52) U.S. Cl.
CPC ..... *E21B 33/04* (2013.01); *E21B 23/00* (2013.01); *E21B 23/01* (2013.01)

(58) Field of Classification Search
CPC ..... E21B 23/01; E21B 33/04; E21B 33/03; E21B 33/043; E21B 33/035; E21B 17/021
See application file for complete search history.

(56) References Cited

U.S. PATENT DOCUMENTS 3,897,823 A * 8/1975 Ahlstone ..... E21B 23/04 166/120
4,674,576 A 6/1987 Goris et al.
5,181,570 A * 1/1993 Allwin ..... E21B 43/10 166/208
2009/0242213 A1 10/2009 Braddick
2013/0056282 A1* 3/2013 Robottom ..... E21B 34/14 175/320
2013/0153796 A1 6/2013 Liu et al.

FOREIGN PATENT DOCUMENTS

GB 2505431 A 5/2014

OTHER PUBLICATIONS

Search report in UK Application No. GB1412498, issued on Dec. 12, 2014, 4 pages.

* cited by examiner

*Primary Examiner* — David Bagnell
*Assistant Examiner* — Tara Schimpf
(74) *Attorney, Agent, or Firm* — Baker Botts L.L.P.

(57) ABSTRACT

Apparatuses and methods for operating a downhole tool are disclosed. A downhole tool configuration device includes an upper stem movable between an up position and a down position. The upper stem comprises an extended portion. An outer sleeve is selectively coupleable to the upper stem at the up position and the down position and an inner sleeve is selectively coupleable to the upper stem at the up position and the down position. In the up position, the upper stem is operable to transfer tension to the outer sleeve and torque to the inner sleeve. In the down position, the upper stem is operable to transfer torque to the outer sleeve.

18 Claims, 2 Drawing Sheets

METHODS AND SYSTEMS FOR OPERATING A DOWNHOLE TOOL

CROSS-REFERENCE TO RELATED APPLICATION

This application claims the benefit of U.S. Provisional Application No. 61/845,475, filed Jul. 12, 2013, which is incorporated herein by reference for all purposes.

BACKGROUND

The present disclosure relates generally to development of subterranean formations and, more particularly, to methods and systems for operating a downhole tool.

With the increasing demand for hydrocarbons, the effective and efficient development of subterranean formations containing hydrocarbons has become critical. A number of different operations are typically performed in order to develop a subterranean formation and extract desired hydrocarbons therefrom. Such operations may include, but are not limited to, drilling operations, fracturing operations, and others. Each operation is typically performed using one or more downhole tools, each performing one or more steps of the particular operation. In many instances, it is desirable to direct a tool downhole and then manipulate the tool as desired to perform a particular step or operation. Accordingly, an important aspect of performing subterranean operations entails the operation of a downhole tool from a surface location or another location uphole.

For instance, it may be desirable to selectively rotate a downhole tool in one direction or another. In certain applications, the downhole tool may have to be rotated to open and close one or more ports in order to perform a desired function. In order to create such a rotation downhole, it is desirable to provide a mechanism that can be used to selectively deliver torque to a downhole location. Further, with respect to certain applications, it may also be desirable to deliver tension (or compression) to a downhole tool. For instance, operation of an inner tube tie-back connector may require delivery of both torque and tension to a downhole tool.

Typically, two approaches may be used to deliver the requisite torque and tension. The first approach entails using a single pipe string which can be run downhole with the required configuration to deliver torque (or tension). The pipe string would then have to be retrieved and reconfigured to deliver tension (or torque) before it is directed back downhole. This is a time consuming and expensive process. A second approach involves using two pipe strings with a first pipe string used to apply torque and another to apply tension. However, this approach is rendered undesirable due to recent reluctance of operators to have more than one pipe string in the shear cavity of a Blow Out Preventer ("BOP") which could raise potential safety and/or environmental concerns. It is therefore desirable to develop a method and system that can effectively deliver torque to a first downhole tool and tension to a second downhole tool or to apply torque to two different downhole tools using a single pipe string.

BRIEF DESCRIPTION OF THE DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to development of subterranean formations and, more particularly, to methods and systems for operating a downhole tool.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

The terms "couple" or "couples," as used herein are intended to mean either an indirect or direct connection. Thus, if a first device couples to a second device, that connection may be through a direct connection, or through an indirect electrical connection via other devices and connections. Further, if a first device is "fluidically coupled" to a second device there may be a direct or an indirect flow path between the two devices. The term "uphole" as used herein means along the drillstring or the hole from the distal end towards the surface, and "downhole" as used herein means along the drillstring or the hole from the surface towards the distal end. However, the use of the terms "uphole" and "downhole" is not intended to limit the present disclosure to any particular wellbore configuration as the methods and systems disclosed herein may be used in conjunction with developing vertical wellbores, horizontal wellbore, deviated wellbores or any other desired wellbore configurations.

Figure 1:
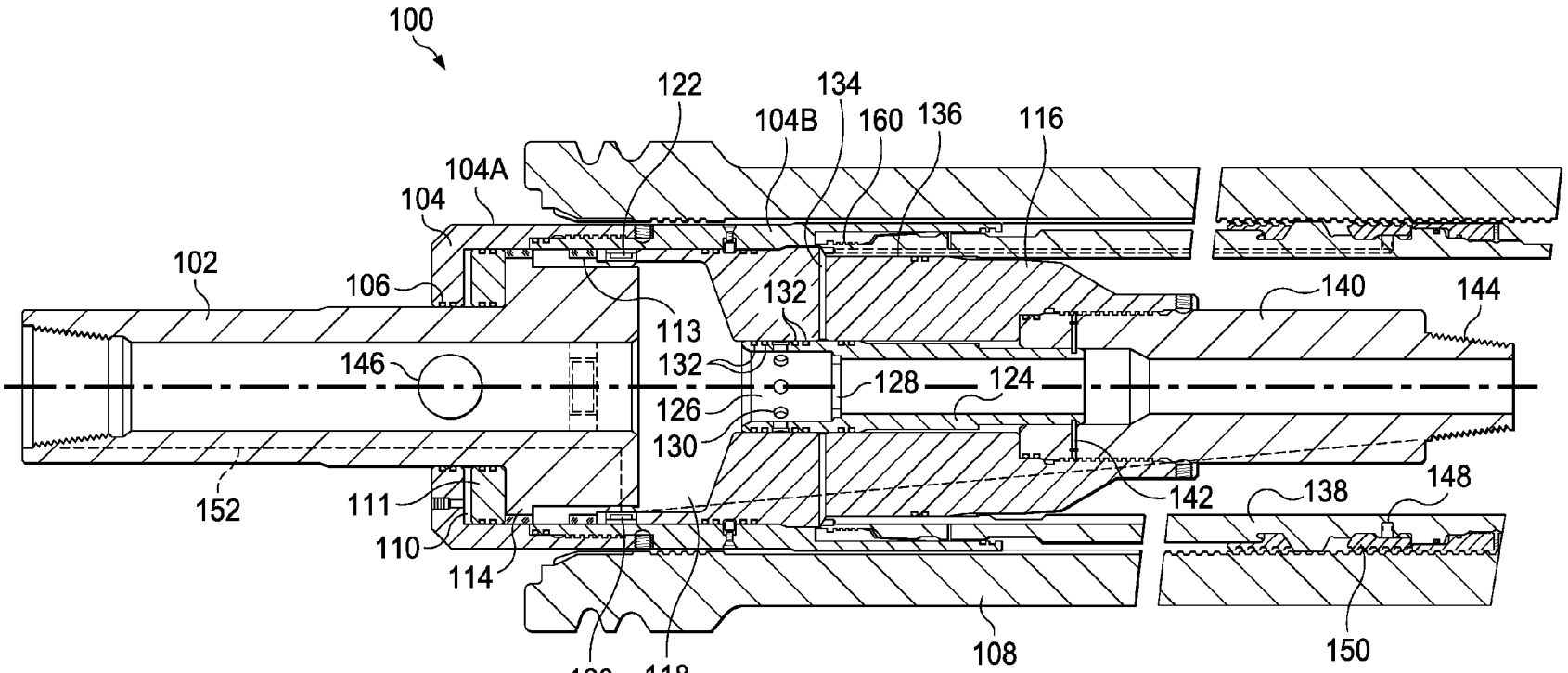
FIG. 1 shows a cross-sectional view of a Downhole Tool Configuration Device ("DTCD") in accordance with an illustrative embodiment of the present disclosure in the up position.

Turning now to FIG. 1, a DTCD in accordance with an illustrative embodiment of the present disclosure is generally denoted with reference numeral 100. The DTCD 100 comprises an upper stem 102 coupled to an outer sleeve 104. In one embodiment, the outer sleeve 104 may comprise an upper outer sleeve portion 104A that is coupled to a lower outer sleeve portion 104B. One or more seal rings 106 may be positioned at the interface between the upper stem 102 and the outer sleeve 104. The outer sleeve 104 is disposed within the wellhead 108.

In the illustrative embodiment of FIG. 1, a hydrostatic fluid bearing 110 is positioned at the interface between the upper stem 102 and the outer sleeve 104. The hydrostatic fluid bearing 110 may contain any suitable fluid including, but not limited to, water, oil, or grease. The fluid of the hydrostatic fluid bearing 110 may be disposed between a surface of the outer sleeve 104 and a seal ring 111. The hydrostatic fluid bearing 110 is shown for illustrative purposes only and may be replaced with other suitable bearings including, but not limited to, a roller bearing or a multi-function type bearing.

The outer sleeve 104 may be disposed adjacent to the hydrostatic fluid bearing 110 and a slot 113 may be disposed further downhole on the outer sleeve 104. The upper stem is movable between an up position (shown in FIG. 1) and a down position (shown in FIG. 2). When the upper stem 102 is in the up position, it is rotationally coupled to an inner sleeve 116, but it is not rotationally coupled to the outer sleeve 104 as described in detail below. In contrast, when the upper stem 102 is in the down position it is rotationally coupled to the outer sleeve 104, but it is not rotationally coupled to the inner sleeve 116.

The upper stem 102 includes an extended portion 114 that is configured to be accommodated within the slot 113 when the upper stem 102 is moved to its down position. Accordingly, when the DTCD 100 is in the up position as shown in FIG. 1, the hydrostatic fluid bearing 110 facilitates coupling between the upper stem 102 and the outer sleeve 104 in a manner that permits transfer of tension between the two components while rotationally isolating the two. Specifically, the hydrostatic fluid bearing 110 ensures that any torque applied to the upper stem 102 is not transferred to the outer sleeve 104 by rotationally isolating the two components when the DTCD 100 is in the up position as shown in FIG. 1. However, even though the hydrostatic fluid bearing 110 rotationally isolates the upper stem 102 from the outer sleeve 104, any axial movement of the upper stem 102 may be transferred to the outer sleeve 104 allowing the outer sleeve 104 to move uphole or downhole within the wellbore as the upper stem 102 moves. The outer sleeve 104 is in turn coupled to a casing hanger 138. In the illustrative embodiment of FIG. 1, the outer sleeve 104 is coupled to the casing hanger 138 through a threaded interface 160. While the fluid in the hydrostatic fluid bearing 110 is compressed if the upper stem is moved uphole, it maintains the rotational isolation between the upper stem 102 and the outer sleeve 104 in this position. As discussed in more detail below in conjunction with FIG. 2, in certain implementations, the extended portion 114 of the upper stem 102 may instead be coupled to a slot 113. As discussed below, the upper stem 102 and the outer sleeve 104 are rotationally coupled when the extended portion 114 is coupled to the slot 113.

Returning now to FIG. 1, the DTCD 100 may further include an inner sleeve 116 that is also disposed within the casing hanger 138 and coupled to the upper stem 102. The inner sleeve 116 is disposed within the outer sleeve 102 as shown in FIG. 1. However, the connection between the upper stem 102 and the inner sleeve 116 is configured differently compared to the connection between the upper stem 102 and the outer sleeve 104. Specifically, the upper stem 102 is coupled to the inner sleeve 116 by dogs 118 having an outer ring 120 which fits into a slot 122 disposed on the inner sleeve 116. This dog connection between the upper stem 102 and the inner sleeve 116 permits transfer of torque between these two components when the upper stem 102 is in the up position as shown in FIG. 1.

A shuttle sleeve 124 is disposed within the inner sleeve 116. The shuttle sleeve 124 includes a ball housing 126 having a ball seat 128 and one or more output ports 130. One or more seal rings 132 may be disposed at the interface between the shuttle sleeve 124 and the inner sleeve 116. The output ports 130 of the shuttle sleeve 124 may be configured to mate with corresponding input ports 134 disposed on the inner sleeve 116 once the shuttle sleeve 124 is transported from a first ("uphole position") to a second ("downhole position") as described in more detail below. The input ports 134 of the inner sleeve 116 are in turn configured to be fluidically coupled to one or more corresponding casing hanger ports 136 that are disposed within a casing hanger 138 located within the wellhead 108.

An adaptor sub 140 may be coupled to a distal end of the inner sleeve 116 using a threaded connection as shown in FIG. 1. The shuttle sleeve 124 may also be coupled to the adaptor sub 140 using one or more shear pins 142. As shown in FIG. 1, a distal end of the shuttle sleeve 124 that is located downhole is disposed within the adaptor sub 140. The adaptor sub 140 may in turn be connected to a downhole tool (not shown) using one or more drill pipes (not shown) that may be coupled thereto through the threads 144.

Figure 2:
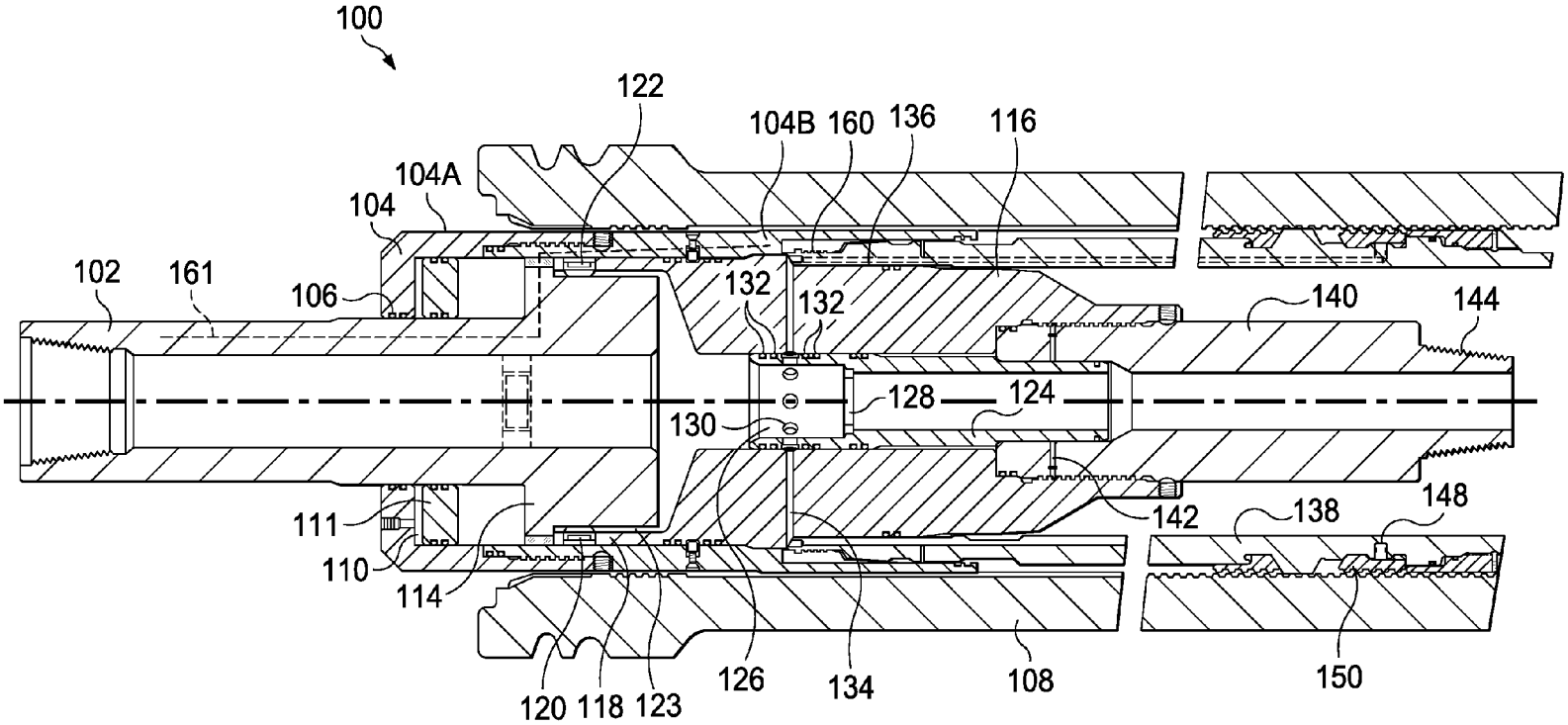
FIG. 2 shows a cross-sectional view of the DTCD of FIG. 1 in the down position.

The operation of the DTCD 100 is now described in further detail in conjunction with FIGS. 1 and 2. In certain illustrative embodiments, a ball 146 may be dropped through the upper stem 102. The ball 146 then falls into the ball housing 126 and rests on the ball seat 128. Once the ball 146 sits in the ball housing 126, it blocks the fluid flow path through the upper stem 102. Accordingly, a fluid may be directed downhole through the upper stem 102 and applies pressure to the shuttle sleeve 124. Once the pressure applied to the shuttle sleeve 124 exceeds a pre-set pressure, the shear pins 142 disengage and the shuttle sleeve 124 moves from its uphole position (shown in FIG. 1) to a downhole position within the inner sleeve 116 and the adaptor sub 140. Once the shuttle sleeve 124 is in its downhole position, the output ports 130 of the ball housing 126 are fluidically coupled to the input ports 134 of the casing hanger 138. Accordingly, a fluid flow path is provided and the fluid that is directed through the upper stem 102 is directed out through the output ports 130 and into the casing hanger 138 through the casing hanger ports 136. The casing hanger ports 136 direct the fluid to a piston 148 which is coupled to an inwardly biased ring 150 which is disposed along a perimeter of the casing hanger 138 and includes a threaded (or grooved) portion that is configured to engage a corresponding threaded (or grooved) portion on the inner surface of the wellhead 108. As fluid flows into the casing hanger ports 136, the pressure applied to the piston 148 increases. Eventually, the pressure applied to the piston 148 exceeds the force that biases the inwardly biased ring 150. At this point, the inwardly biased ring 150 extends out. Consequently, a threaded or grooved engagement between the casing hanger 138 and the wellhead 108 is formed.

Further, the configuration of the DTCD 100 allows an operator to apply tension to a downhole tool (not shown) using the outer sleeve 104 while at the same time delivering torque to the downhole tool using the inner sleeve 116. Specifically, the upper stem 102 may be rotated while at the same time moving uphole or downhole. The hydrostatic fluid bearing 110 rotationally isolates the upper stem 102 from the outer sleeve 104 when the upper stem 102 is in the up position. Therefore, there is no torque transferred from the upper stem 102 to the outer sleeve 104 in this position. However, because the upper stem 102 is coupled to the outer sleeve 104 at the hydrostatic fluid bearing 110, the axial movement of the upper stem 102 uphole and/or downhole is transferred to the outer sleeve 104 causing the outer sleeve 104 and the casing hanger 138 to move in the same manner.

Accordingly, the upper stem 102 and outer sleeve 104 may be used to apply tension without applying torque when the DTCD 100 is in the up position.

In contrast, when the DTCD 100 is in the up position shown in FIG. 1, the upper stem 102 is rotationally coupled to the inner sleeve 116 through the dogs 118. Accordingly, a torque applied to the upper stem 102 is delivered to the inner sleeve 116 through the dogs 118. The inner sleeve 116 then delivers this torque to the adaptor sub 140 through the threaded connection between these two components. Accordingly, the line 152 shows the torque transfer path through the DTCD 100 in accordance with an illustrative embodiment of the present disclosure. Accordingly, in the up position shown in FIG. 1, the DTCD 100 may be used to apply tension to the outer sleeve 104 and torque to the inner sleeve 116.

Turning now to FIG. 2, the DTCD 100 is shown in the down position. When in the down position, the DTCD 100 may be used to transfer torque to the outer sleeve 104. Specifically, when the DTCD 100 is in the down position, the dogs 118 are no longer rotationally coupled to the upper stem 102. The downhole end of the upper stem 102 may include one or more slots 123 milled in its outer diameter. Further, if the upper stem 102 is moved downhole as shown in FIG. 2, the extended portion 114 of the upper stem 102 may engage the slot 113. Once the extended portion 114 engages the slot 113, the upper stem 102 and the outer sleeve 104 may be rotationally coupled and the upper stem 102 may be used to apply torque to the outer sleeve 104. Accordingly, the line 161 in FIG. 2 shows the torque transfer path through the DTCD 100 when the DTCD 100 is in the down position in accordance with an illustrative embodiment of the present disclosure.

Accordingly, the DTCD 100 disclosed herein can be used to selectively operate in a number of different modes of operation. For instance, in a first mode of operation, the DTCD 100 may apply tension to the outer sleeve 104 at the same time torque is applied to the inner sleeve 116. In another mode of operation, the DTCD 100 may apply torque to the outer sleeve 104. Therefore, unlike prior art methods, DTCD 100 may be used to utilize a single pipe string through a BOP to manipulate and/or configure any downhole tools which may require application of both tension and torque or which may require application of torque to different components downhole. For instance, the upper stem 102 may be pulled uphole, allowing the outer sleeve 104 to apply tension to a downhole tool while at the same time the rotation of the upper stem 102 may be delivered to the downhole tool through the inner sleeve 116. Similarly, with the DTCD 100 in the down position, the outer sleeve 104 may apply torque to the casing hanger 138. The ability to apply combination loading in this manner can be beneficial in a number of different applications such as, for example, various phases of utilizing inner-tie back connections for performing drilling and production operations.

Accordingly, the methods and systems disclosed herein may be used to manipulate one or more downhole tools. Specifically, the upper stem 102 may be moved between its up position and its down position. In the up position, the upper stem 102 is coupled to the outer sleeve 104 through the hydrostatic fluid bearing 110 and it is coupled to the inner sleeve 116 through the dogs 118. Thus, the DTCD 100 may be used to apply tension to a first downhole tool through the outer sleeve 104 and it may be used to apply torque to a second downhole tool through the torque transfer path 152. In contrast, when the upper stem 102 is moved to its down position, the extended portion 114 of the upper stem 102 may be coupled to the slot 113. As a result, the upper stem 102 is coupled to the outer sleeve 104 and may apply torque along the torque path 161 to the casing hanger 138.

Although a limited number of seal rings are depicted in FIG. 1, it would be appreciated by those of ordinary skill in the art that seal rings (such as, for example, seal rings 106) may be utilized at the interface of any two components that are coupled to one another as discussed above without departing from the scope of the present disclosure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A downhole tool configuration device, comprising:

an upper stem movable between an up position and a down position, wherein the upper stem comprises an extended portion;

an outer sleeve that is selectively coupleable to the upper stem at the up position and the down position, wherein the outer sleeve is coupled to a casing hanger through a threaded interface;

an inner sleeve that is selectively coupleable to the upper stem at the up position and the down position; and a shuttle sleeve disposed within the inner sleeve, comprising:

a ball housing including a ball seat; and one or more fluid output ports;

wherein:

in the up position the upper stem is operable to transfer tension to the outer sleeve and torque to the inner sleeve; and in the down position the upper stem is operable to transfer torque to the outer sleeve.

2. The tool configuration device of claim 1, wherein:

the outer sleeve comprises an upper outer sleeve portion coupled to a lower outer sleeve portion.

3. The tool configuration device of claim 1, further comprising:

a bearing disposed at the interface between the upper stem and the outer sleeve.

4. The tool configuration device of claim 3, wherein the bearing is selected from a group consisting of a hydrostatic fluid bearing, and a roller bearing.

5. The tool configuration device of claim 3 wherein:

in the up position, the bearing allows for rotational isolation of the upper stem and outer sleeve while facilitating the transfer of axial tension from the upper stem to the outer sleeve.

6. The tool configuration device of claim 1, wherein in the up position, the upper stem is rotationally coupled to the inner sleeve with a dog connection.

7. The tool configuration device of claim 1, wherein in the down position, the extended portion of the upper stem rotationally couples the upper stem to one or more slots of the outer sleeve.

8. The tool configuration device of claim 1, further comprising:

the inner sleeve disposed within the outer sleeve; and an adaptor sub coupled to a distal end of the inner sleeve using a threaded connection.

9. The tool configuration device of claim 1, wherein:

the shuttle sleeve is movable between a first position and a second position;

wherein in the first position the shuttle sleeve is held in place by shear pins attached to the adaptor sub; and wherein in the second position the output ports of the shuttle sleeve are fluidically coupled to input ports disposed on the inner sleeve; and the input ports of the inner sleeve are fluidically coupled to one or more casing hanger ports.

10. The tool configuration device of claim 1, further comprising:

an inwardly biased ring disposed along a perimeter of the casing hanger; and a piston coupled to the inwardly biased ring.

11. The tool configuration device of claim 10, wherein:

the inwardly biased ring further comprises at least one of a threaded portion and a grooved portion configured to engage a corresponding portion on an inner surface of a wellhead.

12. A method of operating downhole tools in a wellbore comprising:

directing a tool configuration device having an upper stem, an outer sleeve and an inner sleeve into the wellbore, wherein the tool configuration device further comprises a shuttle sleeve disposed within the inner sleeve, comprising:

a ball housing including a ball seat; and one or more fluid output ports;

coupling the outer sleeve to a casing hanger;

coupling the inner sleeve to an adaptor sub; and selectively operating the tool configuration device in a first mode of operation and a second mode of operation using the upper stem, wherein, the first mode of operation comprises selectively applying at least one of tension to the outer sleeve and torque to the inner sleeve, and wherein the second mode of operation comprises selectively applying torque to the outer sleeve.

13. The method of claim 12, further comprising coupling the adaptor sub to a downhole tool.

14. The method of claim 13, wherein operating the tool configuration device in the first mode comprises:

positioning the upper stem in a first axial position, wherein the upper stem is rotationally coupled to the inner sleeve and rotationally isolated from the outer sleeve when in the first axial position;

applying the torque to the downhole tool coupled to the adaptor sub by rotating the upper stem; and applying the tension to the outer sleeve by axially moving the upper stem.

15. The method of claim 12, wherein operating the tool configuration device in the second mode comprises:

positioning the upper stem in a second axial position, wherein the upper stem is rotationally coupled to the outer sleeve and rotationally isolated from the inner sleeve when in the second axial position; and applying the torque to the outer sleeve by rotating the upper stem.

16. The method of claim 12, further comprising:

dropping a ball to block a fluid flow path through the shuttle sleeve via landing on the ball seat;

pressurizing fluid uphole of the ball to a pre-set pressure, wherein one or more shear pins locking the shuttle sleeve in place disengage when the pre-set pressure is applied and the shuttle sleeve moves to a downhole position, wherein the one or more fluid output ports of the ball housing align with one or more input ports of the inner sleeve when the shuttle sleeve moves to the downhole position, and fluidically coupling the one or more output ports and the one or more input ports with one or more casing hanger ports.

17. The method of claim 16, further comprising applying a pressure to a piston using the fluid pressure from the one or more casing hanger ports until the pressure is high enough to overcome an inward bias of an inwardly biased ring, and pushing the inwardly biased ring into an engagement between the casing hanger and a wellhead.

18. The method of claim 12, further comprising:

coupling the outer sleeve with the casing hanger using a threaded interface.

* * * * *